US008371500B2

(12) United States Patent
Borton

(10) Patent No.: US 8,371,500 B2
(45) **Date of Patent: *Feb. 12, 2013**

(54) METHOD AND APPARATUS FOR SHEET FEEDING FROM A MEDIA STACK USING A BAR CODE SCANNING DEVICE IN AN IMAGE PRODUCTION DEVICE

(75) Inventor: Michael D. Borton, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 218 days.

This patent is subject to a terminal disclaimer.

(21) Appl. No.: 12/732,698

(22) Filed: Mar. 26, 2010

(65) Prior Publication Data

US 2011/0233270 A1 Sep. 29, 2011

(51) Int. Cl.
*G06F 17/00* (2006.01)

(52) U.S. Cl. ..... 235/375; 271/110

(58) Field of Classification Search ..... 235/375, 235/475; 271/110, 9.02

See application file for complete search history.

(56) References Cited

U.S. PATENT DOCUMENTS

| | | | | |
|---|---|---|---|---|
| 6,604,017 | B1 * | 8/2003 | Richardson et al. | 700/223 |
| 2008/0226369 | A1 * | 9/2008 | Park et al. | 399/374 |
| 2010/0032892 | A1 | 2/2010 | Clark et al. | |

OTHER PUBLICATIONS

Paul J. Degruchy; Method and Apparatus for Media Thickness Measurement in an Image Production Device; U.S. Appl. No. 12/261,463, Filed Oct. 30, 2008.

* cited by examiner

*Primary Examiner* — Edwyn Labaze

(74) *Attorney, Agent, or Firm* — Ronald E. Prass, Jr.; Prass LLP

(57) ABSTRACT

A method and apparatus for sheet feeding from a media stack in an image production device is disclosed. The method may include fluffing a stack of media with a predetermined amount of air flow, sensing sheet separation in the media stack using a bar code scanning device, determining if the sheet separation meets predetermined criteria, wherein if the sheet separation does not meet the predetermined criteria, adjusting the air flow used for fluffing the media stack.

21 Claims, 7 Drawing Sheets

METHOD AND APPARATUS FOR SHEET FEEDING FROM A MEDIA STACK USING A BAR CODE SCANNING DEVICE IN AN IMAGE PRODUCTION DEVICE

BACKGROUND

Disclosed herein is a method for sheet feeding from a media stack using a bar code scanning device in an image production device, as well as corresponding apparatus and computer-readable medium.

One of the more challenging aspects of high speed vacuum corrugated feeder technology is assuring the reliable separation of individual sheets of media away from the media stack. This process is initiated via the use of a media fluffing system. The conventional approach is to spend considerable time developing a media fluffing system which is robust enough to handle in an open-loop fashion all sheets of media within the product specification. Since there is no conventional method for gauging the effectiveness of the media fluffing system in real time, it can take several months to a couple of years worth of testing to refine the fluffing system to assure reliable feeder operation.

SUMMARY

A method and apparatus for sheet feeding from a media stack in an image production device is disclosed. The method may include fluffing a stack of media with a predetermined amount of air flow, sensing sheet separation in the media stack using a bar code scanner, determining if the sheet separation meets predetermined criteria, wherein if the sheet separation does not meet the predetermined criteria, adjusting the air flow used for fluffing the media stack.

DETAILED DESCRIPTION

Figure 1:
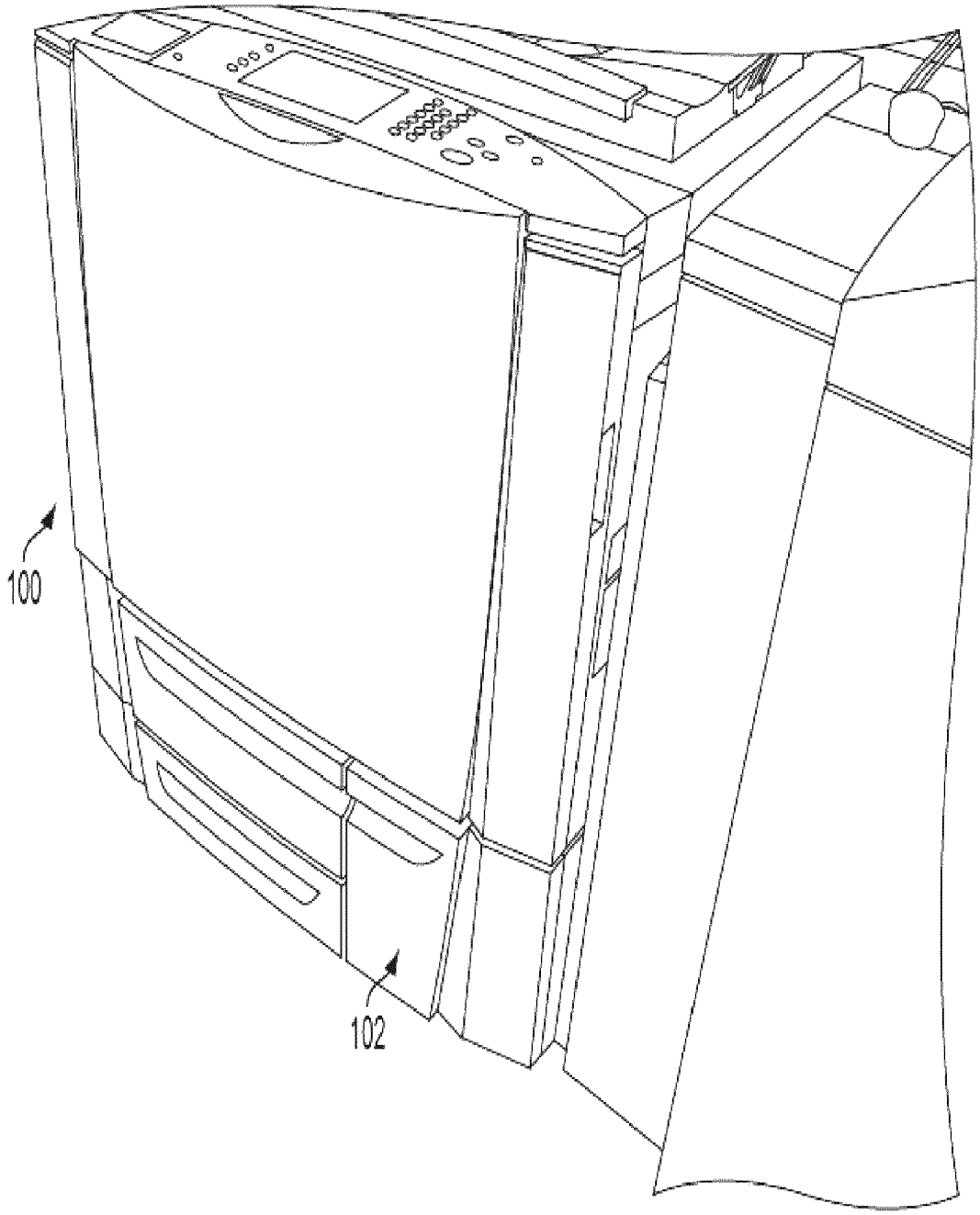
FIG. 1 is an exemplary diagram of an image production device in accordance with one possible embodiment of the disclosure.

Aspects of the embodiments disclosed herein relate to a method for sheet feeding from a media stack in an image production device, as well as corresponding apparatus and computer-readable medium.

The disclosed embodiments may include a method for sheet feeding from a media stack in an image production device. The method may include fluffing a stack of media with a predetermined amount of air flow, sensing sheet separation in the media stack using a bar code scanning device, determining if the media separation meets predetermined criteria, wherein if the sheet separation does not meet the predetermined criteria, adjusting the air flow used for fluffing the media stack.

The disclosed embodiments may further include using a bar code scanning device an image production device that may include a fluffer that fluffs a stack of media in the image production device with a predetermined amount of air flow, a bar code scanning device that senses separation of sheets of media in the media stack, and a fluff management unit that determines if the sheet separation meets predetermined criteria, wherein if the fluff controller determines that the sheet separation does not meet the predetermined criteria, the fluff controller adjusts the air flow used for fluffing the media stack.

The disclosed embodiments may further include a computer-readable medium which stores instructions for controlling a computing device for sheet feeding from a media stack in an image production device. The instructions may include fluffing a stack of media with a predetermined amount of air flow, sensing sheet separation in the media stack using a bar code scanning device, determining if the sheet separation meets predetermined criteria, wherein if the sheet separation does not meet the predetermined criteria, adjusting the air flow used for fluffing the media stack.

The disclosed embodiments may concern a method for sheet feeding from a media stack and process that may be used in conjunction with a vacuum corrugated feeder (VCF). A typical top VCF has four major functional areas. The first function may be handled by the media elevator, which maintains the top of the media stack at a set distance from the bottom of the feedhead. The media fluffing system may then fluff the top several sheets on the stack so that air can readily flow underneath the top sheet as it is acquired by the feedhead. The acquisition function may be handled by the feedhead, with a vacuum system providing the necessary uplift force needed to adhere the top sheet to the feedhead. Finally, the separation function may be enabled both by the feedhead and the air knife or fluffer.

When the feedhead's corrugation pattern corrugates the top sheet, air gaps may be created between the top sheet and any other acquired sheets. An air knife or fluffer may then direct air into these gaps, forcing any other acquired sheets back onto the stack. At this point, the sheet may be transported to the first roller pairs in the media path (also known as take-away rolls) via feed belts or a shuttling feedhead, and the sheet enters the media path.

The primary reliability driver for VCFs is the consistency of sheet separation while the top of the stack is being fluffed. If there is good sheet separation at this point, it is very unlikely that a feeder shutdown event (e.g., misfeed, multi-feed, etc.) will occur. If, however, the sheets clump together while being fluffed, the odds of an event occurring increase dramatically. This is especially true of high speed (120 ppm and higher) VCFs, where there is precious little time available for the separation function to compensate for poorly fluffed media.

The VCFs media fluffing system requires a significant amount of development work to reliably fluff all media typically covered in a product specification. This is principally due to the fact that there is no conventional process to monitor the state of the fluffed media stack, and as a result it is necessary to spend several months to two years to refine the fluffer system to assure reliable performance across all required media and environmental conditions.

This disclosure concerns using bar code scanning technology to scan the edges of fluffed sheets in an image production device. In conventional systems, if the performance of the fluffing system is marginal, the sheets may either fluff in clumps of several sheets or not at all. According to the disclosed embodiments, since the scan timing may be known, the top sheet location and rough size and location of any clumps may be identified. This information may then be used by a fluff controller to adjust the fluffer operating parameters (e.g., static pressure, air burst) as needed to break the sheets back up. Using a bar code scanning device to close the fluffer system control loop may result in enhanced vacuum corrugated feeder robustness as well as reduced development time.

The bar code scanning device may have several other advantages. Since its sensing mechanism may be primarily driven by a laser, it can be located remotely from the sensing point. In reality, there may be a minimum sensing distance of tens of millimeters in order to obtain the length of scan required. The sensing path may be "bent" using mirrors, allowing the scan engine to be mounted around a corner or even under or above the paper tray. The "depth of focus" for this sensor may also provide an advantage as commercial devices currently can read from 100 mm to over 500 mm from the target.

FIG. 1 is an exemplary diagram of an image production device 100 in accordance with one possible embodiment of the disclosure. The image production device 100 may be any device that may be capable of making image production documents (e.g., printed documents, copies, etc.) including a copier, a printer, a facsimile device, and a multi-function device (MFD), for example.

The image production device 100 may include one or more media tray doors 110 and a local user interface 120. The one or more media tray doors 110 may provide access to one or more media trays that contain media. The one or more media tray doors 110 may be opened by a user so that media may be checked, replaced, or to investigate a media misfeed or jam, for example.

The user interface 120 may contain one or more display screen (which may be a touchscreen or simply a display), and a number of buttons, knobs, switches, etc. to be used by a user to control image production device 100 operations. The one or more display screen may also display warnings, alerts, instructions, and information to a user. While the user interface 120 may accept user inputs, another source of image data and instructions may include inputs from any number of computers to which the printer is connected via a network.

Figure 2:
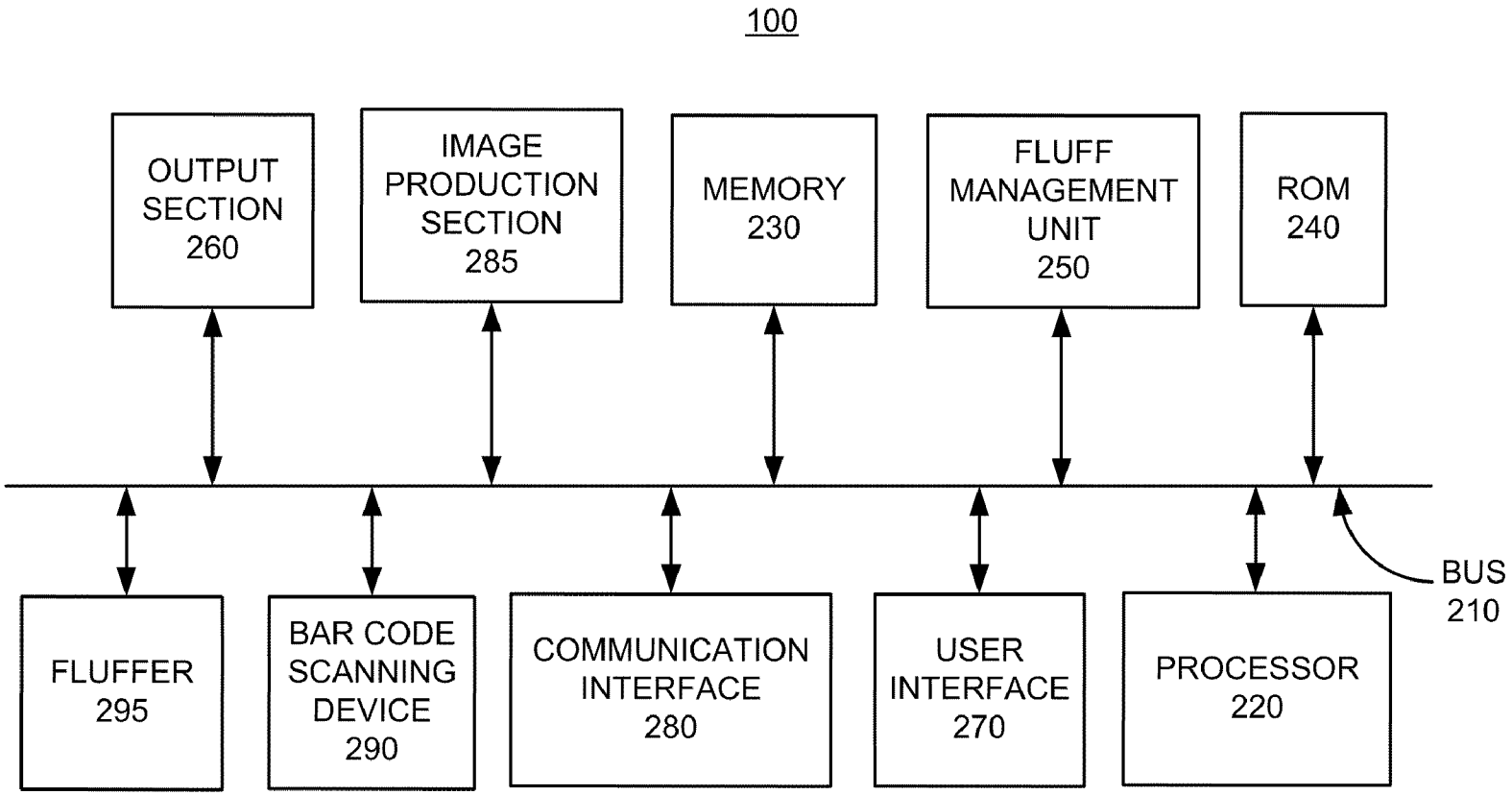
FIG. 2 is a exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM) 240, a fluff management unit 250, an output section 260, a user interface 270, a communication interface 280, an image production section 285, a bar code scanning device 290, and a fluffer 295. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 270 may include one or more conventional mechanisms that permit a user to input information to and interact with the image production unit 100, such as a keyboard, a display, a mouse, a pen, a voice recognition device, touchpad, buttons, etc., for example. Output section 260 may include one or more conventional mechanisms that output image production documents to the user, including output trays, output paths, finishing section, etc., for example. The image processing section 285 may include an image printing and/or copying section, a scanner, a fuser, etc., for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

The operation of the fluff management unit 250 will be discussed in relation to the block diagram in FIG. 3.

Figure 3:
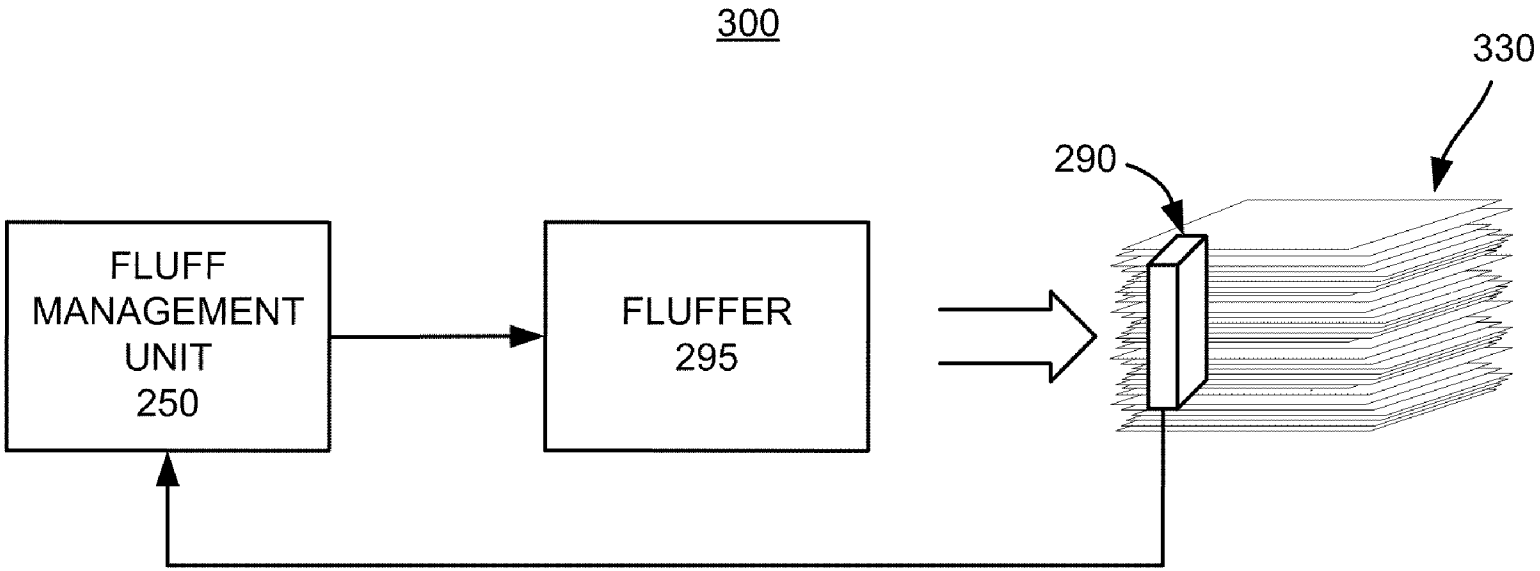
FIG. 3 is a exemplary block diagram of the fluff management environment in accordance with one possible embodiment of the disclosure.

FIG. 3 is an exemplary block diagram of the fluff management environment 300 in accordance with one possible embodiment of the disclosure. The fluff management environment 300 may manage the fluffing of the media stack 310 and may include the fluff management unit 250, a fluffer 295, and a bar code scanning device 290. While the term media stack 310 is used for ease of discussion, the media stack 310 may represent any type of media used to produce documents in the image production device 100, such as any type of paper, plastic, photo paper, cardboard, etc.

The fluffer 295 may be any mechanism known to those of skill in the art that may any arrangement whereby an airflow is directed generally toward the edges of sheets in a portion of a sheet stack.

The bar code scanning device 290 may be a typical bar code scanner such as the ones that are used to streamline the data entry process involved with both the purchasing of and shipping of various goods and material, for example. The bar code scanning device may be any photosensitive device capable of recognizing a pattern of relatively dark and light areas, or other gradations of darkness within a field of view. Such devices can include a photosensor device including a one or two dimensional array of photosensors; a rotating mirror or equivalent, whereby a series of small areas to be considered are sequentially viewed and/or illuminated; or other electromechanical or purely electrical elements arranged to perform this function. A "bar-code scanner" can be of a commercially-available design intended for the reading of bar codes, or can be specially designed for a particular sheet-feeding system design.

The bar code scanning device 290 may be a one-dimensional barcode scanner or a two-dimensional bar code scanner, for example.

Figure 5A:
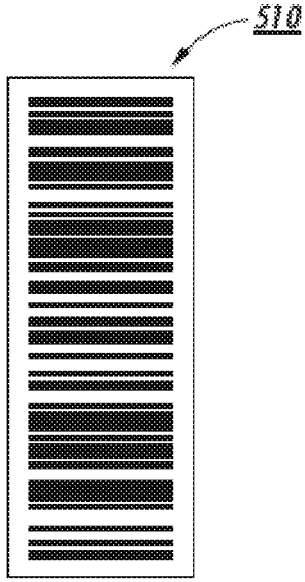
FIGS. 5A and 5B are diagrams of an exemplary bar code and a fluffed media stack, respectively, in accordance with one possible embodiment of the disclosure.
Figure 5B:
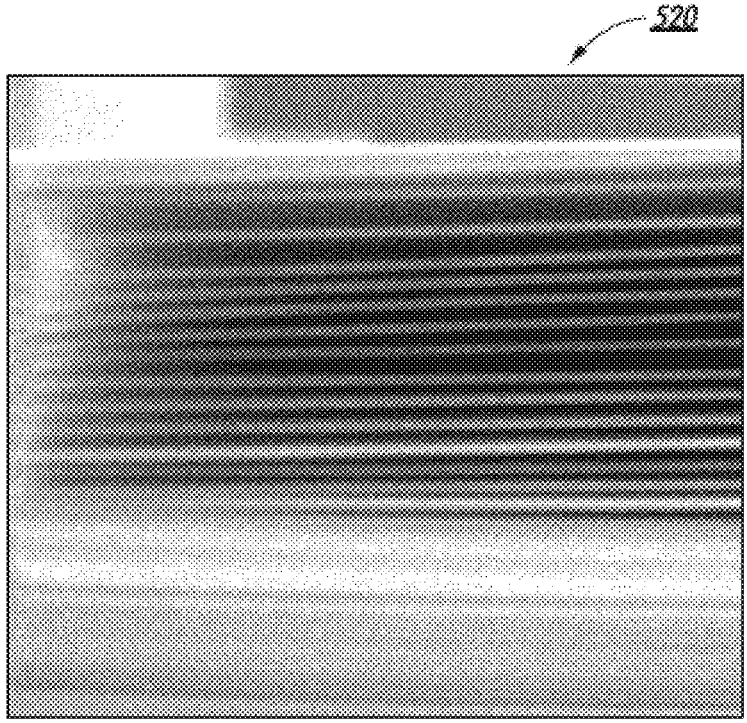

FIGS. 5A and 5B are diagrams of an exemplary bar code 510 and a fluffed media stack 520, respectively, in accordance with one possible embodiment of the disclosure. A typical bar code is shown in FIG. 5A. FIG. 5B shows a side view picture of a fluffed media stack 520. As can be seen, there are definite similarities between the bar code 510 and a fluffed media stack 520. Thus, the bar code scanning device 290 may incorporate bar code scanning technology and may be used to detect the integrity of a fluffing operation. In particular, the bar code scanning device 290 may be able to determine if a group of sheets are clumped together. The fluff management unit 250 may then be able to direct the fluffer 295 to take corrective action by increasing or decreasing air flow in some manner, for example.

Figure 6:
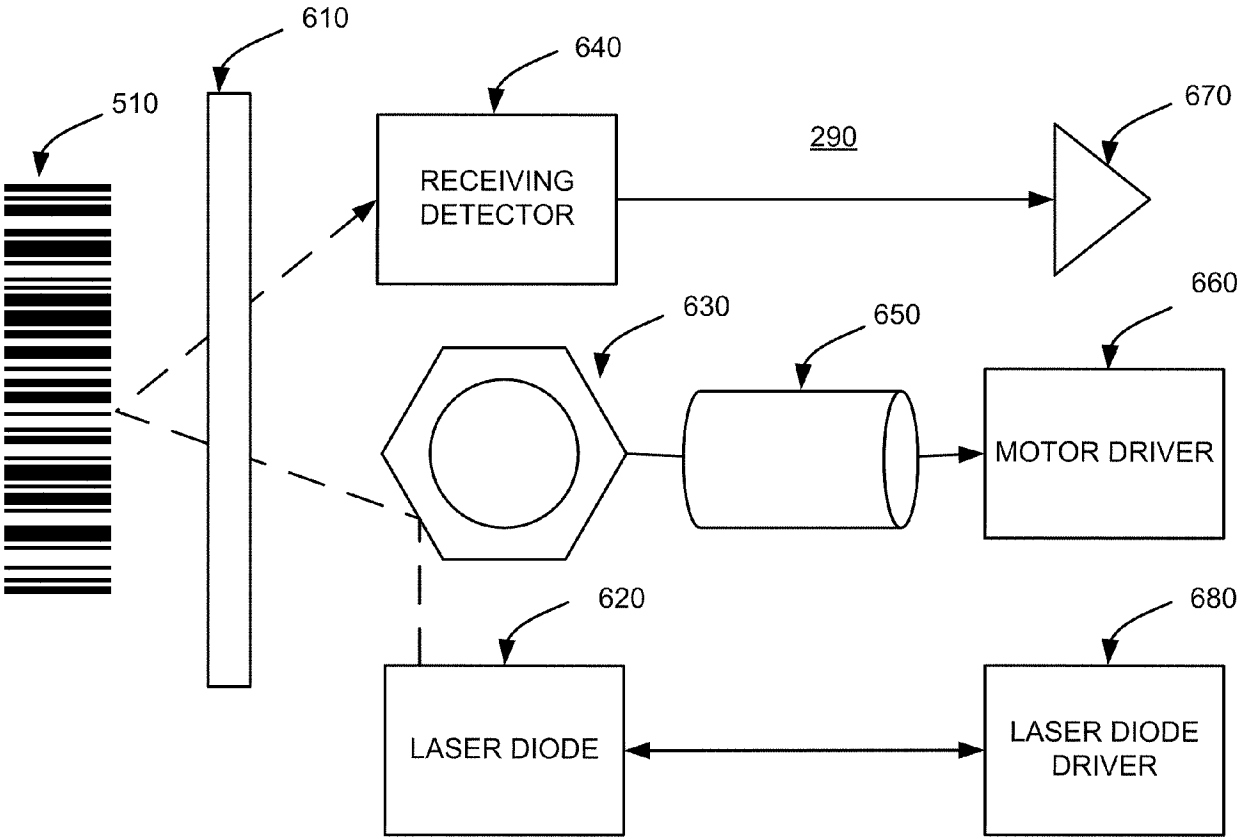
FIG. 6 shows exemplary components of an exemplary bar code scanner in accordance with one possible embodiment of the disclosure.

FIG. 6 shows exemplary components of an exemplary bar code scanner 290 in accordance with one possible embodiment of the disclosure. A typical bar code scanning device 290 may include a glass cover 610 that covers the scanner mechanisms that may include a laser diode 620 to provide a light signal for scanning, one or more mirrors 630 which may rotate and reflect the light, a receiving detector 640 that detects the scanned signals from the bar code 510, a DC motor 650 and a motor driver 660 to drive the rotating mirrors 620, a low-noise amplifier 670, and a laser diode driver 680 to drive the laser diode 610, for example. Since its sensing mechanism may be primarily driven by a laser, the bar code scanning device 290 can be located remotely from the sensing point. There may be a minimum sensing distance of tens of millimeters in order to obtain the length of scan required, for example. The sensing path may be "bent" using mirrors, allowing the bar code scanning device 290 to be mounted around a corner or even under or above the paper tray. The "depth of focus" for the bar code scanning device 290 may also provide an advantage as commercial devices currently can read from 100 mm to over 500 mm from the target.

The operation of components of the fluff management unit 250, the fluff management environment 300, and the fluff management process will be discussed in relation to the flowchart in FIG. 4.

Figure 4:
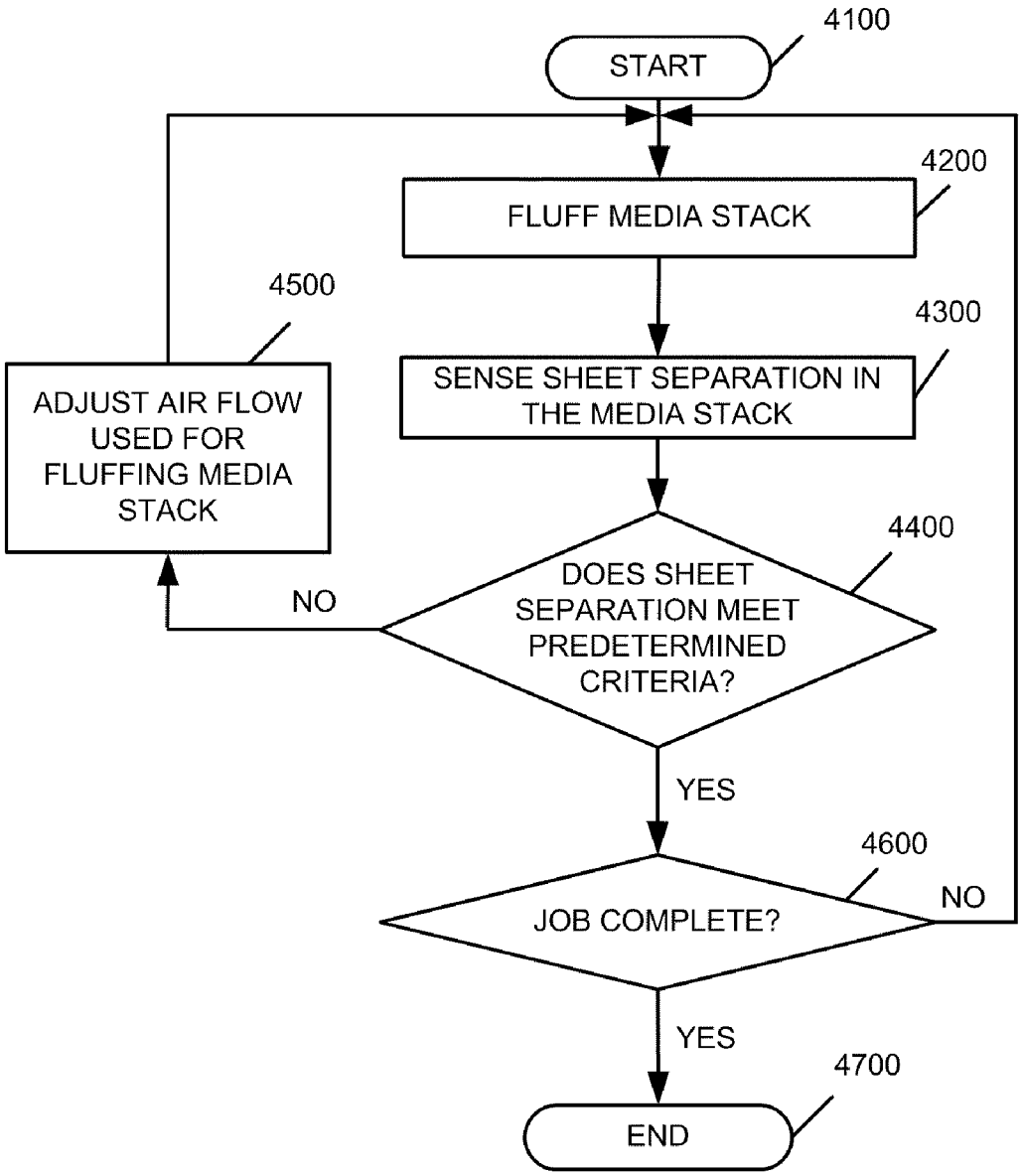
FIG. 4 is a flowchart of an exemplary fluff management process in accordance with one possible embodiment of the disclosure.

FIG. 4 is a flowchart of a fluff management process in accordance with one possible embodiment of the disclosure. The method begins at 4100, and continues to 4200 where the fluffer 295 may fluff a stack of media 310 in the image production device 100 with a predetermined amount of air flow. At step 4300, the bar code scanning device 290 may sense the separation of sheets of media in the media stack 310. The sensing of sheet separation may be performed by measuring one of gaps between sheets of media in the media stack or the thickness of the sheets of media in the media stack, for example.

At step 4400, the fluff management unit 250 may determine if the sheet separation meets predetermined criteria. The predetermined criteria may be the time per sheet of media, for example. As the scan rate is known, the time per sheet of media can then be used to calculate the sheet thickness. Should the calculated thickness of a given fluffed sheet be substantially greater than the thickness of other fluffed sheets, the given fluffed sheet may actually represent a group of sheets clumped together. If the fluff management unit 250 determines that the sheet separation does not meet the predetermined criteria, then at step 4500 the fluff management unit 250 may adjust the air flow used for fluffing the media stack 310. The air flow adjustment may be one of an increase in air pressure or a burst of air, for example. The process then returns to step 4200.

If at step 4400, the fluff management unit 250 determines that the sheet separation meets the predetermined criteria, then the process goes to step 4600 where the fluff management unit 250 determines whether the print job is complete. If the fluff management unit 250 determines that the print job is not complete, the process returns to step 4200. If the fluff management unit 250 determines that the print job is complete, the process may then go to step 4700 and end.

Figure 7:
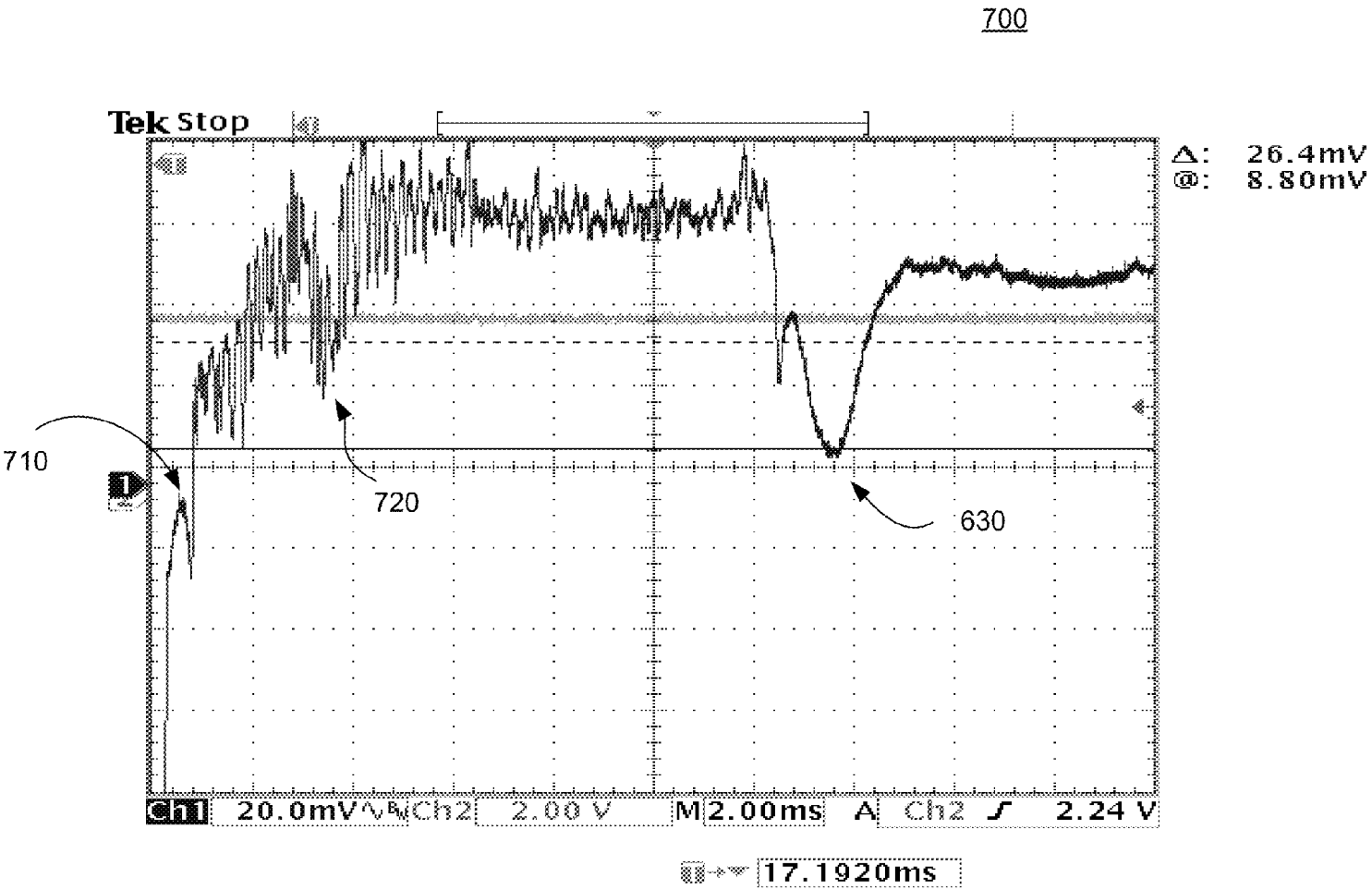
FIG. 7 is a graph illustrating the signal from the bar code scanning device while reading a media stack in accordance with one possible embodiment of the disclosure.

FIG. 7 is a graph illustrating the signal from the bar code scanning device while reading a media stack 310 in accordance with one possible embodiment of the disclosure. As shown, the reading form the bar code scanning device 290 easily identifies the top sheet 710 of the media stack 310, individual sheets 720 of the media stack 310, and the interface between media reams 730. In this manner, the gaps between the media sheets and thickness of the media sheets may be detected and measured against predetermined criteria, for example.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for sheet feeding from a media stack in an image production device, comprising:

fluffing a stack of media with a predetermined amount of air flow;

sensing sheet separation in the media stack using a bar code scanning device;

determining if the sheet separation meets predetermined criteria, wherein if the sheet separation does not meet the predetermined criteria, adjusting the air flow used for fluffing the media stack.

2. The method of claim 1, further comprising:

determining if a print job is complete, wherein if the print job is complete, stopping the air flow to the media stack.

3. The method of claim 1, wherein the bar code scanning device is one of a one-dimensional barcode scanner and a two-dimensional bar code scanner.

4. The method of claim 1, wherein the predetermined criteria is the scan time per sheet of media.

5. The method of claim 1, wherein the air flow adjustment is one of an increase in air pressure and a burst of air.

6. The method of claim 1, wherein sensing the sheet separation is performed by measuring one of gaps between sheets of media in the media stack and thickness of the sheets of media in the media stack.

7. The method of claim 1, wherein the image production device is one of a copier, a printer, a facsimile device, and a multi-function device.

8. A fluff management unit for use in an image production device, comprising:

a fluffer that fluffs a stack of media in the image production device with a predetermined amount of air flow;

a bar code scanning device that senses separation of sheets of media in the media stack; and a fluff controller that determines if the sheet separation meets predetermined criteria, wherein if the fluff controller determines that the sheet separation does not meet the predetermined criteria, the fluff controller adjusts the air flow used for fluffing the media stack.

9. The fluff management unit of claim 8, wherein the fluff controller determines if a print job is complete, wherein if the fluff controller determines that the print job is complete, the fluff controller stops the air flow to the media stack.

10. The fluff management unit of claim 8, wherein the bar code scanning device is one of a one-dimensional barcode scanner and a two-dimensional bar code scanner.

11. The fluff management unit of claim 8, wherein the predetermined criteria is the scan time per sheet of media.

12. The fluff management unit of claim 8, wherein the air flow adjustment is one of an increase in air pressure and a burst of air.

13. The fluff management unit of claim 8, wherein the fluff sensor senses the sheet separation by measuring one of gaps between sheets of media in the media stack and thickness of the sheets of media in the media stack.

14. The fluff management unit of claim 8, wherein the image production device is one of a copier, a printer, a facsimile device, and a multi-function device.

15. A non-transitory computer-readable medium storing instructions for controlling a computing device for sheet feeding from a media stack in an image production device, the instructions comprising:

fluffing a stack of media with a predetermined amount of air flow;

sensing sheet separation in the media stack using a bar code scanning device;

determining if the sheet separation meets predetermined criteria, wherein if the sheet separation does not meet the predetermined criteria, adjusting the air flow used for fluffing the media stack.

16. The non-transitory computer-readable medium of claim 15, further comprising:

determining if a print job is complete, wherein if the print job is complete, stopping the air flow to the media stack.

17. The non-transitory computer-readable medium of claim 15, wherein the bar code scanning device is one of a one-dimensional barcode scanner and a two-dimensional bar code scanner.

18. The non-transitory computer-readable medium of claim 15, wherein the predetermined criteria is the scan time per sheet of media.

19. The non-transitory computer-readable medium of claim 15, wherein the air flow adjustment is one of an increase in air pressure and a burst of air.

20. The non-transitory computer-readable medium of claim 15, wherein sensing the sheet separation is performed by measuring one of gaps between sheets of media in the media stack and thickness of the sheets of media in the media stack.

21. The non-transitory computer-readable medium of claim 15, wherein the image production device is one of a copier, a printer, a facsimile device, and a multi-function device.

* * * * *